United States Patent [19]

Svirklys et al.

[11] Patent Number: 4,655,156

[45] Date of Patent: Apr. 7, 1987

[54] FLOTATION SYSTEM

[75] Inventors: Ferdinand M. Svirklys, Toronto; Peter G. Lancucki, Scarborough, both of Canada

[73] Assignee: Dominion Al-Chrome Corporation Ltd., Toronto, Canada

[21] Appl. No.: 701,997

[22] Filed: Feb. 15, 1985

[51] Int. Cl.[4] ..... B63B 35/38

[52] U.S. Cl. ..... 114/266; 114/267

[58] Field of Search ..... 114/263, 266, 267, 352, 114/77 R, 77 A; 405/219; 52/593, 589; 441/77

[56] References Cited

U.S. PATENT DOCUMENTS

| | | | |
|---|---|---|---|
| 2,206,205 | 3/1939 | Selby | 52/593 X |
| 2,660,194 | 8/1952 | Hoffman | 114/267 X |
| 3,193,855 | 7/1965 | Chapman | 114/267 |
| 3,788,254 | 1/1974 | Sheil | 114/266 |
| 3,936,897 | 2/1976 | Schaumann | 441/77 |
| 4,263,865 | 4/1981 | Shorter, Jr. | 114/267 |
| 4,418,634 | 12/1983 | Gerbus | 114/263 |

FOREIGN PATENT DOCUMENTS

| | | | |
|---|---|---|---|
| 128976 | 12/1984 | European Pat. Off. | 114/77 A |

*Primary Examiner*—Joseph F. Peters, Jr.
*Assistant Examiner*—Paul E. Salmon
*Attorney, Agent, or Firm*—Sim & McBurney

[57] ABSTRACT

Floating structures, for example, for recreational aquatic activities, comprises a plurality of individual uniquely-constructed modular flotation units constructed to permit any desired freeboard dimension and/or buoyancy characteristics.

4 Claims, 8 Drawing Figures

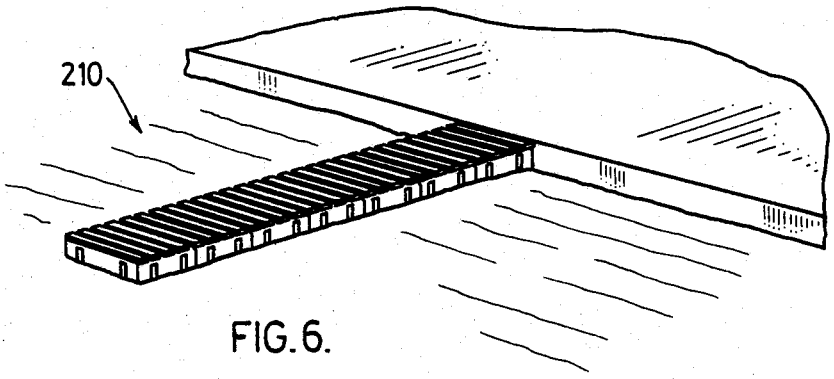
FIG. 6.
FIG. 1.
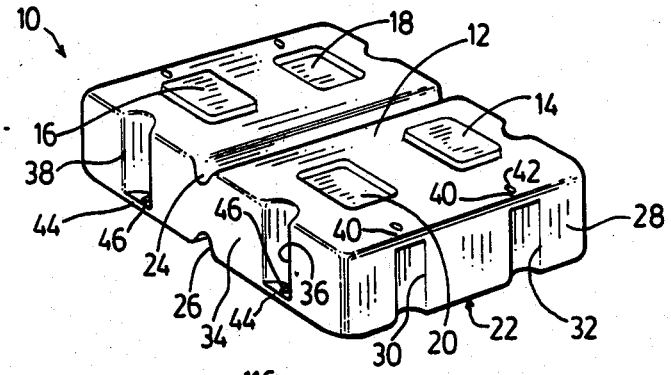
FIG. 2.
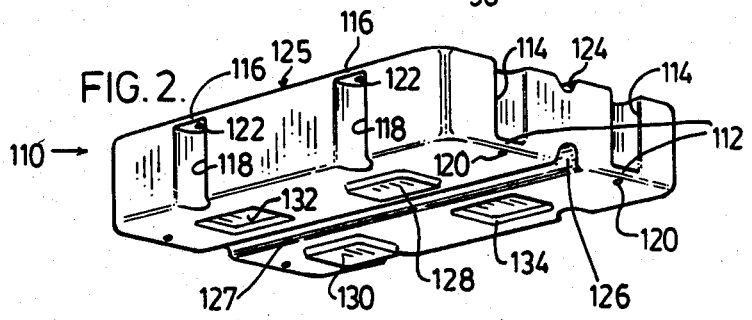
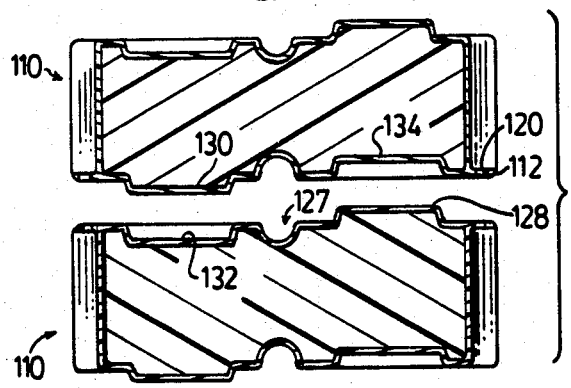
FIG. 3.
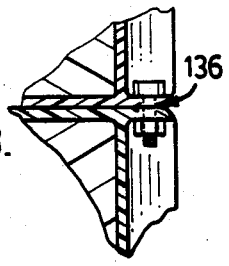
FIG. 4.

FLOTATION SYSTEM

FIELD OF INVENTION

The present invention relates to flotation systems comprising modular flotation units.

BACKGROUND TO THE INVENTION

Floating structures of various types are used for recreational aquatic activities, including docks, marinas and pontoons. Such structures generally comprise some form of a flotation means immersed partially or wholly in the water and some form of decking attached to the flotation means. The flotation means generally are customized for the particular structure and do not permit modification.

SUMMARY OF INVENTION

In accordance with the present invention, there is provided a modular floating unit which permits the construction of floating structures having any desired configuration, size and floating characteristics. The present invention also includes the floating structures produced from the individual flotation units, including docks, marinas and pontoons.

BRIEF DESCRIPTION OF DRAWINGS

FIG. 1 is a perspective view of one form of flotation unit constructed in accordance with the invention;

FIG. 2 is a perspective view of another form of flotation unit constructed in accordance with the invention;

FIG. 3 is a sectional view of two of the units of FIG. 2 in stacked relation;

FIG. 4 is a detailed view of the manner of joining together the nested units of FIG. 3;

FIG. 6 is a perspective view of a floating dock structure embodying flotation units constructed in accordance with the present invention;

DESCRIPTION OF PREFERRED EMBODIMENT

Figure 7:
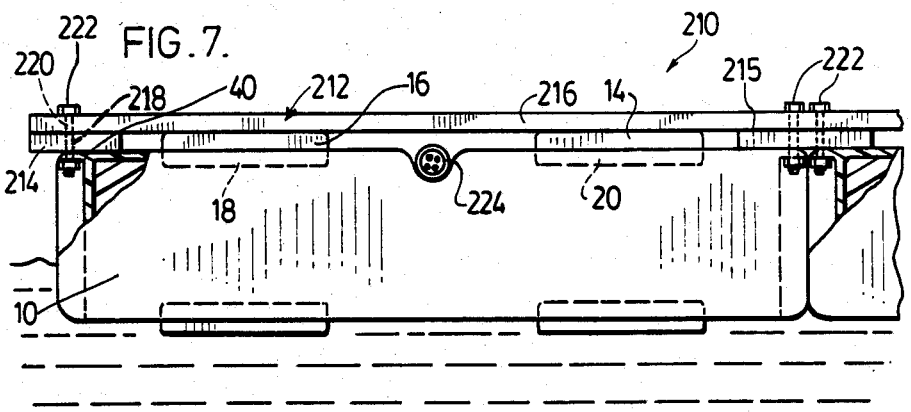
FIG. 7 is an end view of the floating dock of FIG. 6.

Referring to the drawings, there are illustrated in FIGS. 1 and 2, two alternative forms of a flotation unit constructed in accordance with one embodiment of the invention. As may be seen in FIG. 1, a flotation unit 10 has a generally cubic or box-like construction. The upper surface 12 has a pair of rectangular cross-sectioned protrusions 14, 16 arranged diagonally with respect to each other and a pair of rectangular cross-sectioned depressions 18, 20 arranged diagonally with respect to each other.

The undersurface 22 of the flotation unit 10 is provided also with pairs of diagonally-arranged protrusions and depressions (not shown in FIG. 1 but can be seen for the unit illustrated in FIG. 2). The protrusions 14 and 16 are complemented by a depression at the same locations on the undersurface 22 and the depressions 18 and 20 are complemented by a protrusion at the same locations on the undersurface 22. The protrusions 14, 16 and the depressions 18, 20 are of the same lateral, longitudinal and depth dimensions. The arrangement and dimensioning of the protrusions and depressions permits multiples of the unit 10 to be stacked and interconnected one with another, as described below with respect to FIGS. 3 and 4.

Both the upper surface 12 and the lower surface 22 of the flotation unit 10 have a groove 24, 26 formed therein extending from one longitudinal side edge to the other and bisecting the area of the respective surface into two halves. This arrangement enables the depressions 24 and 26 of one flotation unit 10 to align with those of another flotation unit 10 when the units are side abutted to receive utility conduits.

Formed in each end wall 28 of the flotation unit 10 is a pair of part-circular depressions 30, 32 while formed in each side wall 34 is a pair of part-circular depressions 36, 38. The part-circular end-wall depressions 30, 32 are located in the same locations in each end wall 28 while similarly the part-circular side-wall depressions 36, 38 are located in the same location in each side wall 34.

The part-circular end-wall depressions 30, 32 extend for substantially the height of the end wall 28 and terminate at their upper end in a part-circular compression weld seal 40 integral with the adjoining portions of the flotation unit 10 and are open at the lower end. A bore 42 is formed through each seal 40.

The part-circular side-wall depressions 36, 38 extend for substantially the height of the side wall 34 and terminate at their lower end in a part-circular compression weld seal 44 integral with the adjoining portion of the flotation unit 10 and are open at the upper end. A bore 46 is formed through each seal 44.

Referring now to FIG. 2, there is illustrated therein an alternative form of flotation unit 110 which is similar to the flotation unit 10 but has important differences which permits the flexibility of construction of floating structures discussed below.

In the structure of FIG. 2, the compression weld seals associated with side-wall and end-wall depressions are located at the opposite end to the arrangement used in the flotation unit 10. Thus, part-circular compression weld seals 112 are located at the lower end of end-wall depressions 114, while compression weld seals 116 are located at the upper end of side-wall depressions 118. The seals 112 each has a bore 120 therethrough while the seals 116 each has a bore 122 therethrough.

In addition, in the structure of FIG. 2, the upper and lower surface grooves extend longitudinally of the surfaces rather than transversely as in FIG. 1. Thus elongate depressions 124 and 126 formed in the upper and lower surfaces 125, 127 respectively of the flotation unit 110 extend longitudinally of the unit 110 bisecting the surface. As in the case of the depressions 24, 26 the depressions 124, 126 of one flotation unit 110 are intended to align with those of other units 110 when such units are abutted end-to-end.

As in the case of flotation unit 10, the flotation unit 110 has a pair of diagonally-located projections 128, 130 extending from both the upper and lower surface. In addition, a pair of diagonally-located recesses or depressions 132, 134 extend into both the upper and lower surfaces. In the embodiment of FIG. 2, the projections 128, 130 and depressions 132, 134 are shown on the lower surface 127 of the flotation unit 110. Similar pairs of projections and depressions are provided at the opposite locations on the upper surface 125 of the unit 110, as illustrated for the upper surface of the flotation unit 10 of FIG. 1.

As mentioned previously, the projections and depressions provided on the upper and lower surfaces of the flotation units 10 and 110 permit the flotation units to be stacked one on another with the projections from the undersurface of one unit extending into the depressions in the upper surface of the lower unit and the projections from the upper surface of the lower unit similarly extending into the depressions in the undersurface of the upper unit. The nesting of the projections and depressions locks the stacked flotation units in a fixed relation to each other. The stacked units may be fastened together by interaction with the bores formed through the seals.

The stacking together of two of the flotation units 110 and the fastening together of the stacked units is illustrated in FIGS. 3 and 4. As seen therein, two flotation units 110 may be stacked one on another, with the lower unit 110 being turned upside down from the arrangement seen in FIG. 2. The complementary locations of the projections 128, 130 and the depressions 132, 134 on the upper and lower surfaces 125, 127 of the flotation unit 110 and their diagonally-spaced locations enables the projections and depressions to be nested, thereby joining the flotation units together and preventing the face-abutted units 110 from relative lateral movement.

With the lower flotation unit 110 turned upside-down before stacking, the end wall compression seals 112 abut each other in the two units 110 with the bores 120 in alignment. This abutment of the seals 112 and alignment of the bores 120 permits the stacked units to be fastened together by the use of bolts 136 or similar fastening means passing through the aligned openings 120, as may be seen from the detail of FIG. 4.

Any desired number of the flotation units 110 may be formed into a stack, depending on the buoyancy characteristics desired. As greater numbers are added to the stack, the buoyancy increases. As discussed in detail below, this arrangement may be employed to provide a floating structure having varying buoyancy characteristics within the overall structure.

To add a third member to the stack, a further unit 110 is used in the orientation shown in FIG. 2, if being stacked on the bottom of the stack or upside-down from the orientation of FIG. 2, if being stacked on the top of the stack, whichever is the more convenient. The protrusions and depressions of the abutting faces nest with one another, as in the case of the first two members, as described above. In either case, i.e. stacked on the top or on the bottom, the side-wall compression seals 116 are in abutting relation, with the bores 122 in alignment. The third member of the stack is fastened to the other two members by bolts passing through the aligned bores 122, in analogous manner to that shown in the detail of FIG. 4 for the first two members 110 of the stack.

This operation can be repeated for any desired number of the flotation units 110 in the stack, with the vertically-adjacent units being fastened into the stack at either the top or bottom of the stack through the appropriate abutting seals. The units 110 in the stack alternate in orientation with respect to that shown in FIG. 2, so as to provide the required adjacent location of seals to permit joining together of the units.

Similarly, a stack may be formed from the flotation units 10. In this instance, the first two units 10 in the stack are connected together through abutting seals 44 using bolts passing through aligned openings 46, and then the next unit 10 in the stack is connected to the other two at abutting seals 40. Stacks also may be formed from combinations of flotation units 10 and 110, as a result of the modular nature of each of the flotation units, with the units being suitably oriented to provide abutted seals and aligned bores to receive the fastening elements.

Stacks of units 10 and units 110 may be provided in this manner with each stack containing the same number of flotation units or a variable number of units. In each stack, whether it be formed from the flotation units 10 or flotation units 110, has at the upper surface of the stack openings 42 or 122 which may be used as attachment points for stringers to enable multiple stacks of flotation units and/or individual flotation units to be joined in side-to-side or end-to-end abutted relationship, depending on whether flotation units 10 or 110 are present as the top surface unit. By the utilization of such stringers, floating structures of simple or complex shape with uniform or variable flotation characteristics, may be formed from the stacks of flotation units and from individual flotation units.

The individual flotation units 10 and 110 may be constructed of any desired material which provides a buoyant structure. In one embodiment of the invention, the flotation units 10 and 110 are blow moulded as hollow units from a suitable thermoplastic or thermosetting polymeric material, for example, and then filled with rigid polyurethane foam or other suitable foam material.

The flotation units 10 and 110 have a modular structure, as just described. The units 10 and 110 usually have common lateral and longitudinal dimensions and are the same as each other, for example, 2 feet×3 feet, although they may be provided with variable depth, to alter the flotation characteristics of the individual units, to provide further versatility in providing a floating structure having variable flotation characteristics, as may be seen in FIG. 5. Typically, the flotation units 10 and 110 may have a depth of 5 inches or 8 inches.

The multidirectional nature of the flotation units 10 and 110, as described above, permits floating structures of 2, 3, 4, 5 or more feet in width and length to be provided. The floating structures, therefore, can have an almost infinitely variable freeboard and/or buoyancy, without the necessity of expensive custom building, as used in the prior art. Once constructed from the flotation units 10 or 110, the floating structure is capable of further variation in freeboard and/or buoyancy, again in complete contrast to the prior art.

Figure 5:
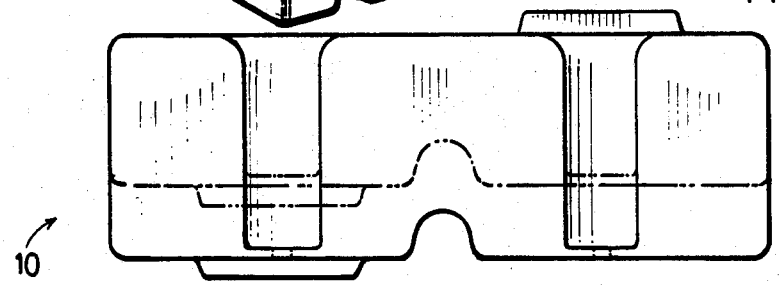
FIG. 5 is an end view of two of the flotation units, illustrating differing depths.

Turning now to consideration of FIGS. 5 to 7, there is illustrated therein a floating dock structure 210 formed from flotation units 10. The floating dock 210 comprises a plurality of flotation units 10 underlying a deck 212. The deck 212 comprises a pair of elongate stringers 214, 215 located at the sides of the floating structure and a plurality of transverse boards 216 extending for the width of the dock 210.

Figure 8:
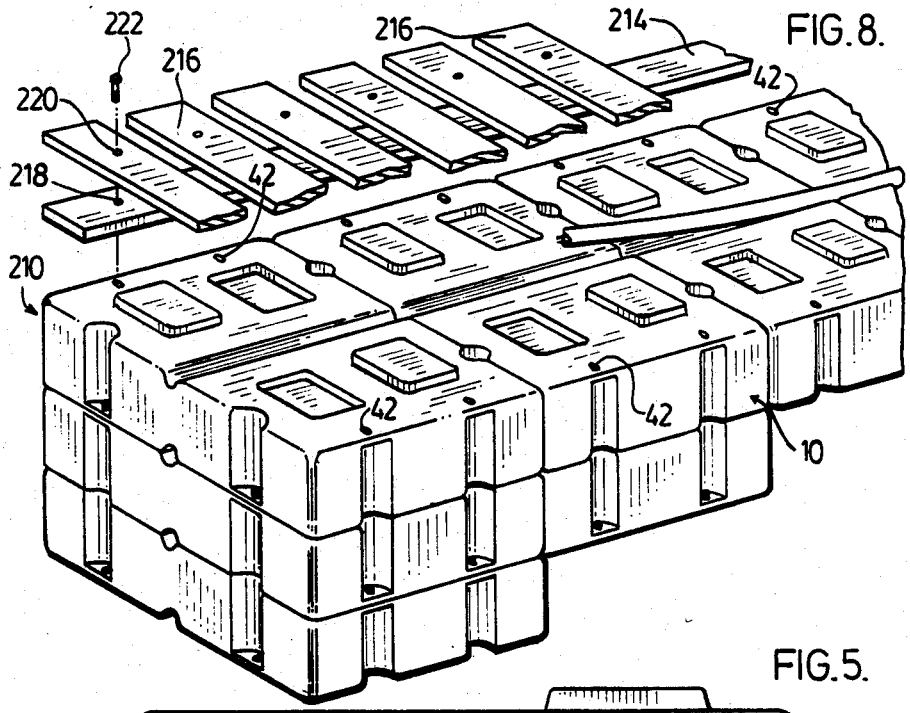
FIG. 8 is an exploded view of the dock structure of FIG. 6.

As may be seen particularly in FIG. 8, stacks of one, two, three or more flotation units 10 are located in side-face abutting relationship to define the basic shape of the dock 210. The structure illustrated in FIGS. 6 and 8 is a floating dock 210 having a width equal to the width of the individual units 10. It is apparent from the foregoing description that additional units 10 may be side-abutted to the end-faces of the floating structure, as illustrated in FIG. 7.

The openings 42 of the top-most units 10 of the side face-abutted individual units or stacks are located in straight-line alignment, to permit joining together of these elements in the manner now described. The stringers 214 are laid the length of the dock 210 over the horizontally-aligned openings 42. Bores 218 are provided through the stringers 214 in alignment with the openings 42. The transverse boards 216 are laid on top of the stringers 214 at the locations of the individual openings 42 and have openings 220 which align with openings 218 and 42. Bolts 222 then are passed through the openings 220 in the boards 216, openings 218 in the stringers 214 and openings 42 in the flotation units 10 at each location of opening 42 to assemble the dock structure.

As seen in FIG. 7, the side-abutted units are assembled with the main unit by extending the transverse boards 216 for the total width of the floating structure, providing double-width stringers 215 (or a pair of individual stringers 214) and using bolts 222 passing through the perspective aligned openings.

The grooves 24 of the abutting flotation units 10 are aligned in the dock structure 210 and may be used as a channel for utility wires or pipes 224, if desired.

It will be appreciated from the above description that additional stacks of flotation units may be end-face abutted to either side of the primary floating structure, with the cross-members 216 extending for the width of the resulting structure to act as stringers to join the end-abutting members together and thereby provide an overall tying together of the stacks.

The stacks of two flotation units 10 exhibit more buoyancy than a single flotation unit 10 and the buoyancy increases with increasing numbers of flotation units in a stack. By combining stacks of different numbers of flotation units and individual flotation units of varying depth in a single floating structure by the suitable use of stringers as described above, a floating structure may be provided which has differential areas of buoyancy, which may be used to support superstructures of differing weights at differing locations on the structure.

Similar floating structures may be provided from flotation units 110, except that end-face abutment of the adjacent units is used to define the longitudinal direction of the overall structure. As mentioned earlier, the modular nature of the flotation units 10 and 110 enables floating structures of any desired freeboard dimension and/or buoyancy to be provided, either all from units 10, all from units 110 or mixtures of units 10 and 110.

The modular nature of the flotation units of the present invention combined with their unique manner of nesting and attachment one to another provides a considerable versatility in the size, shape and buoyancy characteristics of floating structures to be achieved which has heretofore not been the case. The resulting floating structure may be employed for a variety of purposes, including recreational aquatic activities.

SUMMARY OF DISCLOSURE

In summary of this disclosure, the present invention provides a novel flotation unit and novel floating structures formed therefrom. Modifications are possible within the scope of the invention.

What I claim is:

1. A modular flotation unit useful for vertical assembly with other like flotation units to provide floating structures of desired buoyancy, which comprises:

a generally cubic or box-like shape having upper and lower surfaces, end surfaces and side surfaces and constructed to float on water, said upper surface having a pair of diagonally-spaced protrusions and a pair of diagonally-spaced depressions complementarily-shaped with respect to said protrusions, said lower surface having a pair of diagonally-spaced protrusions located complementarily to said depressions in said top surface and a pair of diagonally-spaced depressions located complementarily to said protrusions in said top surface and complementarily-shaped with respect to said protrusions, each said end wall having at least one depression extending for substantially the height thereof and terminating in a wall at the upper end and open at the lower end, each said side wall having at least one depression extending for the height thereof and terminating in a wall at the lower end and open at the upper end, each said wall having a bore therethrough to enable abutted walls of surface-abutting flotation units to be fastened together by fastening means engaging the aligned bores.

2. The flotation unit of claim 1, wherein each said protrusion and depression is rectangularly shaped.

3. The flotation unit of claim 1 including a depression formed in at least one of said upper and lower surfaces and extending between either the side surfaces or the end surfaces to bisect the respective surface into two substantially equal area segments.

4. The flotation unit of claim 1 wherein said fastening means comprises bolt means.

* * * * *